US005975854A

United States Patent [19]

Culp, III et al.

[11] Patent Number: 5,975,854

[45] Date of Patent: Nov. 2, 1999

[54] COMPRESSOR WITH PROTECTION MODULE

[75] Inventors: Charles H. Culp, III, Marshalltown, Iowa; Hank E. Millet, Piqua; Suresh Shivashankar, Sidney, both of Ohio; Birchard M. Taylor, Burlington, Conn.

[73] Assignee: Copeland Corporation, Sidney, Ohio

[21] Appl. No.: 08/853,864

[22] Filed: May 9, 1997

[51] Int. Cl.[6] ..... F04B 49/00

[52] U.S. Cl. ..... 417/18; 417/32; 417/44.1

[58] Field of Search ..... 417/12, 18, 32, 417/44.1; 418/55.5, 55.1

[56] References Cited

U.S. PATENT DOCUMENTS

| | | | |
|---|---|---|---|
| 3,735,377 | 5/1973 | Kaufman | 340/248 P |
| 3,763,397 | 10/1973 | Yockers | 317/9 R |
| 3,783,681 | 1/1974 | Hirt et al. | 73/119 R |
| 4,060,716 | 11/1977 | Pekrul et al. | 364/576 |
| 4,102,394 | 7/1978 | Botts | 166/65 |
| 4,372,119 | 2/1983 | Gillbrand et al. | 60/600 |
| 4,390,321 | 6/1983 | Langlois et al. | 417/15 |
| 4,390,922 | 6/1983 | Pelliccia | 361/170 |
| 4,399,548 | 8/1983 | Castleberry | 377/16 |
| 4,425,010 | 1/1984 | Bryant et al. | 308/227 |
| 4,429,578 | 2/1984 | Darrel et al. | 73/659 |
| 4,479,389 | 10/1984 | Anderson, III et al. | 73/651 |
| 4,884,412 | 12/1989 | Sellers et al. | 62/115 |
| 4,909,076 | 3/1990 | Busch et al. | 73/168 |
| 4,913,625 | 4/1990 | Gerlowski | 417/18 |
| 5,056,036 | 10/1991 | Van Bork | 364/510 |
| 5,109,700 | 5/1992 | Hicho | 73/660 |
| 5,203,178 | 4/1993 | Shyu | 62/180 |
| 5,224,835 | 7/1993 | Oltman | 417/12 |
| 5,362,206 | 11/1994 | Westerman et al. | 417/44 |
| 5,509,786 | 4/1996 | Mizutani et al. | 417/32 |
| 5,602,757 | 2/1997 | Haseley et al. | 364/555.01 |
| 5,610,339 | 3/1997 | Haseley et al. | 73/660 |
| 5,707,210 | 1/1998 | Ransey et al. | 417/32 |

*Primary Examiner*—Charles G. Freay
*Assistant Examiner*—Robert Z. Evora
*Attorney, Agent, or Firm*—Harness, Dickey & Pierce, P.L.C.

[57] ABSTRACT

A protection system for a scroll machine provides temperature, mis-wiring and vibrational protection for the scroll machine. The vibrational protection comprises a vibration sensor which is integrated on the circuit board of the protection system. The vibration sensor, in conjunction with at least one timer, monitors the vibrations of the scroll machine and will shut down the machine when excess vibrations are sensed over a prespecified period of time. The temperature system monitors operating temperature conditions and the mis-wiring system monitors the power supplied to the compressor. Once an undesirable characteristic is identified, the operation of the scroll machine is stopped. These protection systems are integrated into a single module which identifies the reason of shutting off the scroll machine in order to simplify repairs needed.

20 Claims, 3 Drawing Sheets

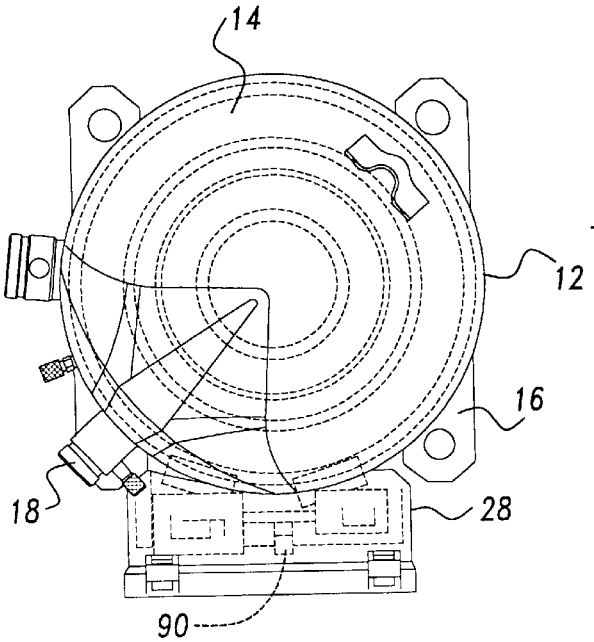
Fig-2
Fig-3
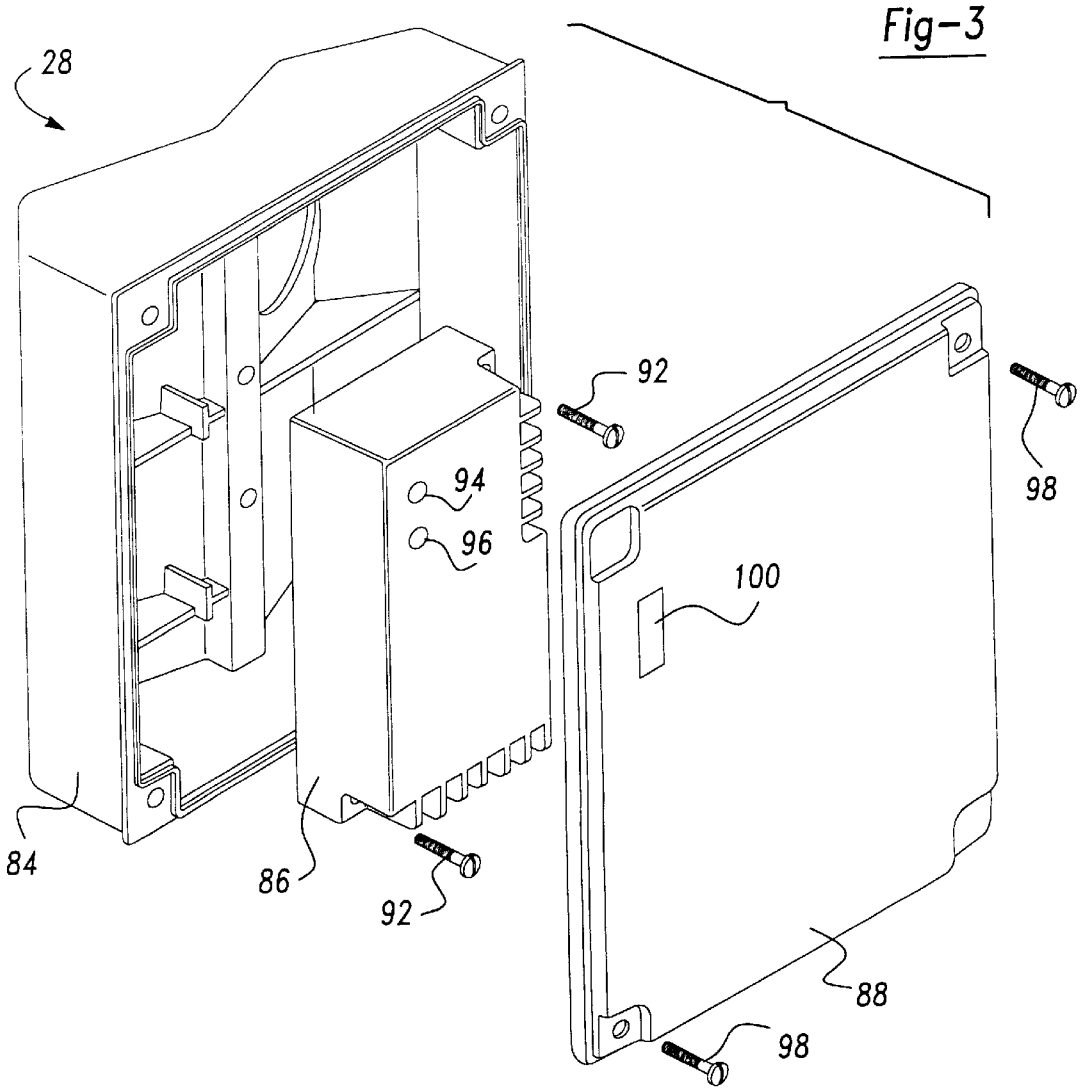

COMPRESSOR WITH PROTECTION MODULE

FIELD OF THE INVENTION

The present invention relates to the control of compressors. More particularly, the present invention relates to a compressor protection module which combines compressor temperature, phase and vibration protection functions in a single module.

BACKGROUND AND SUMMARY OF THE INVENTION

Scroll type machines are becoming more and more popular for use as compressors in both refrigeration as well as air conditioning applications due primarily to their capability of extremely efficient operation. Generally, these machines incorporate a pair of intermeshed spiral wraps, one of which is caused to orbit relative to the other so as to define one or more moving chambers which progressively decrease in size as the travel from an outer suction port toward a center discharge port. The means for causing the orbiting of one of the scroll members is in many cases an electrical motor. The electric motor operates to drive the one scroll member via a suitable drive shaft affixed to the motor rotor. In a hermetic compressor, the bottom of the hermetic shell normally contains an oil sump for lubricating and cooling purposes.

Scroll compressors depend upon a number of seals to be created to define the moving or successive chambers. One type of seal which must be created are the seals between opposed flank surfaces of the wraps. These flank seals are created adjacent to the outer suction port and travel radially inward along the flank surface due to the orbiting movement of one scroll with respect to the other scroll. Additionally sealing is required between the end plate of one scroll member and the tip of the wrap of the other scroll member. Because scroll compressors depend upon the seals between flank surfaces of the wraps and the seals between the end plates and opposing wrap tips, suction and discharge valves are generally not required.

While the prior art scroll machines are designed to run trouble free for the life of the scroll machine, it is still necessary to monitor the operation of the compressor and discontinue its operation when specific criteria have been exceeded. Typical operational characteristics which are monitored include the discharge temperature of the compressed refrigerant, the temperature of the motor windings, three-phase reverse rotational protection, three-phase missing phase/single phase protection and an anti-short cycle. The monitoring of these characteristics and the methods and devices for monitoring these characteristics have been the subject of numerous patents.

Recently, it has been found that by monitoring the vibrational characteristics of the scroll machine, it is possible to predict problems with a scroll machine before these problems result in a failure to the entire system. For instance, in a refrigeration or air conditioning system which incorporates numerous scroll machines, the abnormal vibration of one of the scroll machines can result in a fracture of the refrigeration tube associated with that individual scroll machine. The fracture of this tube will result in a total loss of the system refrigerant, possible damage to property, expensive repairs and in some cases could be hazardous. Accordingly, what is needed is a device which is capable of independently monitoring the vibrational characteristics of an individual scroll machine.

The present invention provides the art with a vibration sensing system which is incorporated into a more comprehensive compressor protection module which monitors all of the various operating characteristics of the compressor. The vibration sensing system will open the control circuit and stop compressor operation when the signal from a vibration sensor of the system exceed a preset limit for an accumulated time period.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 2 is a top plan view of the compressor shown in FIG. 1;

FIG. 3 is a perspective view of the terminal box assembly shown in FIG. 2;

DETAILED DESCRIPTION OF THE PREFERRED EMBODIMENTS

Figure 1:
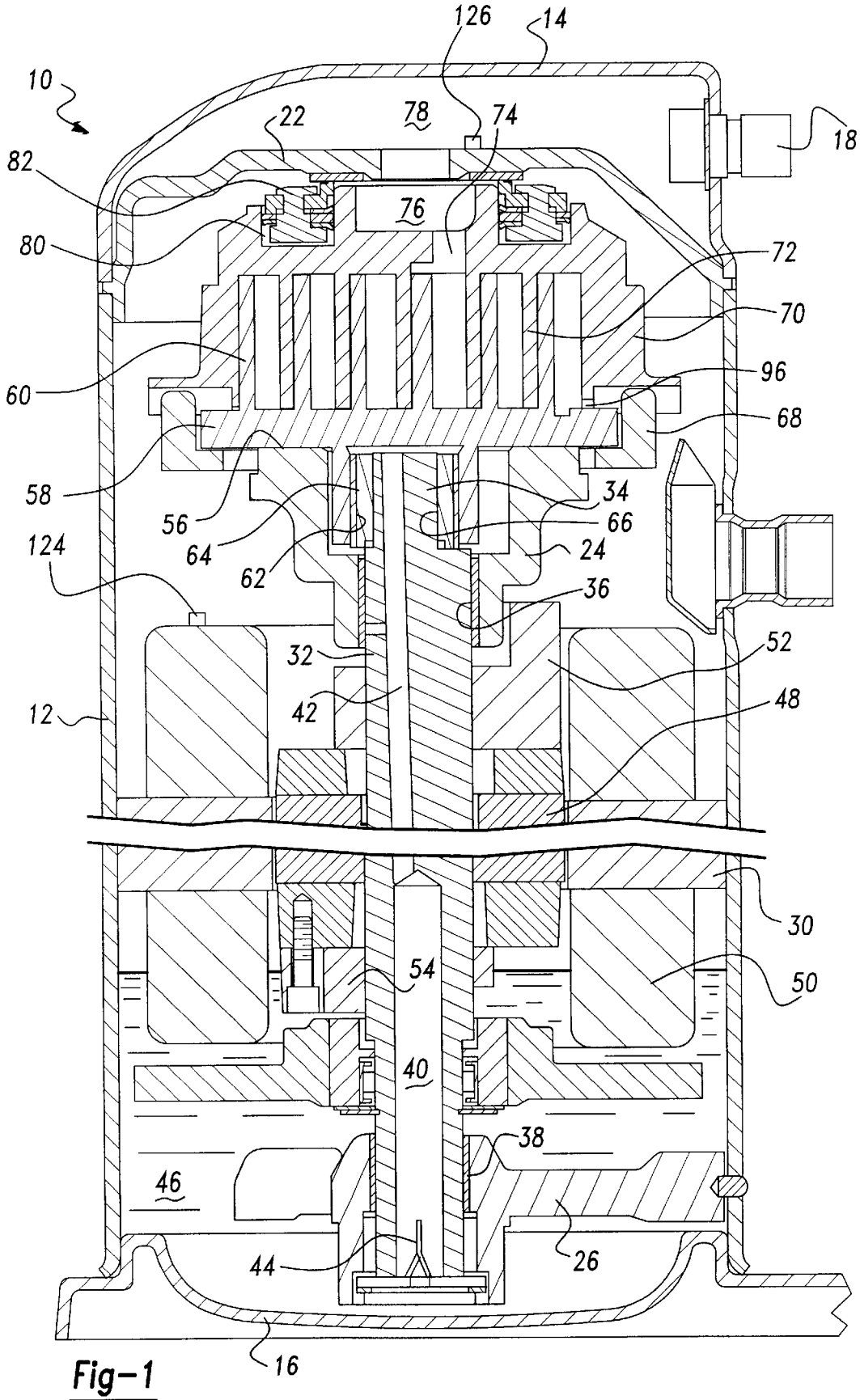
FIG. 1 is a vertical cross-sectional view through the center of a scroll type refrigeration compressor incorporating the control system in accordance with the present invention.

Referring now to the drawings in which like reference numerals designate like or corresponding parts throughout the several views, there is shown in FIGS. 1 and 2 a scroll compressor which incorporates the control system in accordance with the present invention which is designated generally by reference numeral 10. Compressor 10 comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). Other major elements affixed to the shell include a transversely extending partition 22 which is welded about its periphery at the same point that cap 14 is welded to shell 12, a main bearing housing 24 which is suitably secured to shell 12, a lower bearing housing 26 also having a plurality of radially outwardly extending legs each of which is also suitably secured to shell 12 and a terminal box assembly 28 (FIG. 2). A motor stator 30 which is generally square in cross-section but with the corners rounded off is press fitted into shell 12. The flats between the rounded corners on the stator provide passageways between the stator and shell, which facilitate the return flow of lubricant from the top of the shell to the bottom.

A drive shaft or crankshaft 32 having an eccentric crank pin 34 at the upper end thereof is rotatably journaled in a bearing 36 in main bearing housing 24 and a second bearing 38 in lower bearing housing 26. Crankshaft 32 has at the lower end a relatively large diameter concentric bore 40 which communicates with a radially outwardly inclined smaller diameter bore 42 extending upwardly therefrom to the top of crankshaft 32. Disposed within bore 40 is a stirrer 44. The lower portion of the interior shell 12 defines an oil sump 46 which is filled with lubricating oil to a level slightly above the lower end of a rotor 48, and bore 40 acts as a pump to pump lubricating fluid up the crankshaft 32 and into passageway 42 and ultimately to all of the various portions of the compressor which require lubrication.

Crankshaft 32 is rotatively driven by an electric motor including stator 30, windings 50 passing therethrough and rotor 48 press fitted on the crankshaft 32 and having upper and lower counterweights 52 and 54, respectively.

The upper surface of main bearing housing 24 is provided with a flat thrust bearing surface 56 on which is disposed an orbiting scroll member 58 having the usual spiral vane or wrap 60 on the upper surface thereof. Projecting downwardly from the lower surface of orbiting scroll member 58 is a cylindrical hub having a journal bearing 62 therein and in which is rotatively disposed a drive bushing 64 having an inner bore 66 in which crank pin 32 is drivingly disposed. Crank pin 32 has a flat on one surface which drivingly engages a flat surface (not shown) formed in a portion of bore 66 to provide a radially compliant driving arrangement, such as shown in assignee's U.S. Pat. No. 4,877,382, the disclosure of which is hereby incorporated herein by reference. An Oldham coupling 68 is also provided positioned between orbiting scroll member 58 and bearing housing 24 and keyed to orbiting scroll member 58 and a non-orbiting scroll member 70 to prevent rotational movement of orbiting scroll member 58. Oldham coupling 68 is preferably of the type disclosed in assignee's copending U.S. Pat. No. 5,320,506, the disclosure of which is hereby incorporated herein by reference.

Non-orbiting scroll member 70 is also provided having a wrap 72 positioned in meshing engagement with wrap 60 of orbiting scroll member 58. Non-orbiting scroll member 70 has a centrally disposed discharge passage 74 which communicates with an upwardly open recess 76 which in turn is in fluid communication with a discharge muffler chamber 78 defined by cap 14 and partition 22. An annular recess 80 is also formed in non-orbiting scroll member 70 within which is disposed a seal assembly 82. Recesses 76 and 80 and seal assembly 82 cooperate to define axial pressure biasing chambers which receive pressurized fluid being compressed by wraps 60 and 72 so as to exert an axial biasing force on non-orbiting scroll member 70 to thereby urge the tips of respective wraps 60, 72 into sealing engagement with the opposed end plate surfaces. Seal assembly 82 is preferably of the type described in greater detail in U.S. Pat. No. 5,156,539, the disclosure of which is hereby incorporated herein by reference. Non-orbiting scroll member 70 is designed to be mounted to bearing housing 24 in a suitable manner such as disclosed in the aforementioned U.S. Pat. No. 4,877,382 or U.S. Pat. No. 5,102,316, the disclosure of which is hereby incorporated herein by reference.

Referring now to FIG. 3, terminal box assembly 28 includes a terminal box 84, a protection module 86 and a terminal box cover 88. Terminal box 84 is mounted to shell 12 using a plurality of studs 90 (FIG. 2) which are resistance welded to shell 12. Protection module 86 is mounted within terminal box 84 using a pair of mounting screws 92. Protection module 86 is connected to the various components of compressor 10 using wiring which has been omitted from the Figures for purposes of clarity. The connections for protection module will be discussed in greater detail below. Protection module 86 includes a green indicator light 94 and a red indicator light 96. Lights 94 and 96 indicate the status of protection module 86 and the operating status of compressor 10. Terminal box cover 88 is attached to terminal box 84 using a plurality of screws 98. Cover 88 defines an aperture 100 which aligns with lights 94 and 96 to enable an individual to determine the operating status of compressor 10 without having to remove cover 88.

Figure 4:
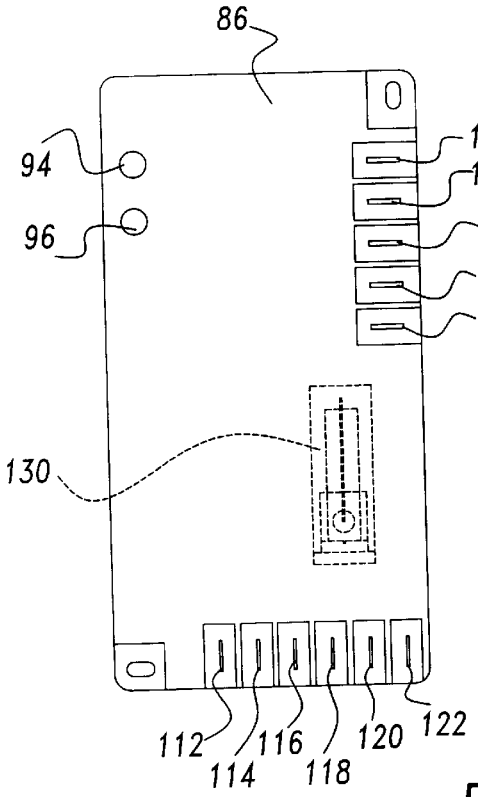
FIG. 4 is a side view of the protection module shown in FIG. 3.

Referring now to FIG. 4, a side view of protection module 86 is shown. Protection module 86 includes indicator lights 94 and 96 as well as terminals 102, 104, 106, 108 and 110 on one side of module 86 and terminals 112, 114, 116, 118, 120 and 122 located on a second side of module 86. Terminals 102, 104 and 106 are connected directly to the first, second and third phase wiring for compressor 10 in order to monitor the status of the three-phase power supply for compressor 10. Terminals 108 and 110 are connected to the temperature sensing system of compressor 10. The temperature sensing system may include a thermistor or thermo couple 124 for each winding 50 of the electric motor, a thermistor or thermo couple 126 for the temperature of the discharge gas or any combination of these sensors or other sensors used to monitor the operating temperature of compressor 10.

Terminals 112 and 114 are connected to a source of power for protection module 86. This source of power could be directly from the incoming power supply or it could be provided by some type of isolated power supply. Terminals 116 and 118 are connected to an auxiliary alarm which would produce an audible and/or visual indication that compressor 10 has been shut down by protection module 86. Normally this alarm would be located away from the individual compressor to an area easily and readily accessible by an individual. Terminals 120 and 122 are connected to the compressor control system to indicate that all monitored systems are acceptable and compressor 10 is free to operate.

Figure 5:
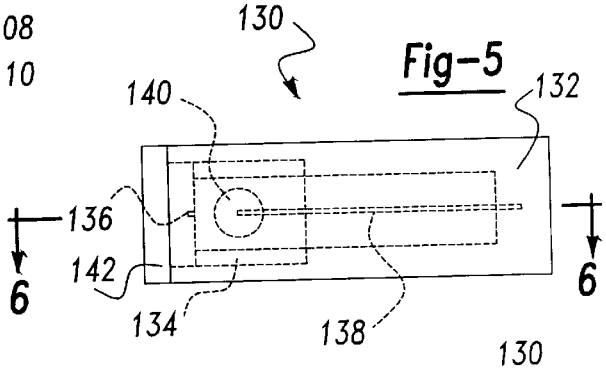
FIG. 5 is a top plan view of the preferred implementation of the vibration sensor incorporated into the protection module shown in FIG. 4.
Figure 6:
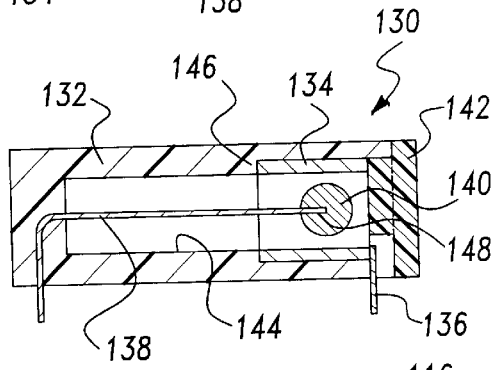
FIG. 6 is a side cross sectional view of the vibration sensor shown in FIG. 5.

Vibration detection is added to protection module 86 by incorporating a preferred vibration sensor 130 within protection module 86 as shown in dashed lines in FIG. 4. Vibration sensor 130 is shown in FIGS. 5 and 6 and it comprises a cover 132, a contactor ring 134, a terminal rod 136, a spring wire 138, a ball 140, and an end cap 142. Cover 132 is a generally rectangular shaped plastic component defining a internal circular bore 144. Contactor ring 134 is fit within an enlarged portion of bore 144 and rests against a shoulder 146 formed by bore 144. Terminal rod 136 extends through a side wall of cover 132. Terminal rod 136 is welded to contactor ring 134 such that the end of terminal rod 136 extending through cover 132 can be utilized as a solder point for vibration sensor 130.

Spring wire 138 is an L-shaped wire member which has one end of the L extending through the side wall of cover 132 and the opposite end of the L extending axially down the center line of circular bore 144 such that the end of spring wire 138 terminates in approximately the center of contactor ring 134. Ball 140 includes a radially extending bore 148 which extends from the outer surface of ball 140 to approximately the center of ball 140. Preferably, ball 140 and spring wire 138 are assembled by inserting spring wire 138 into bore 148 and applying a strong permanent epoxy or by other methods known well in the art. The end of spring wire 138 which extends out of cover 132 is used as a solder point for vibration sensor 130. End cap 142 is attached to cover 132 by use of a permanent set epoxy which seals bore 144 and thus protects the electrical contacts of vibration sensor 130.

Preferably, spring wire 138 is made from spring quality steel or music wire, ball 140 is made form stainless steel (either 302 or 304) and contactor ring 134 is made from a seamless 304 stainless steel hollow tubular stock. Contactor ring 134 and ball 140 are preferably plated with gold up to a thickness of 0.000015 inches to prevent oxidation. In the preferred method of fabricating, spring wire 138 and contactor ring 134 are molded in place. Ball 140 is then secure to spring wire 138 and then end cap 142 is assembled.

Ball 140 and spring wire 138 comprise a simple spring-mass system. Spring wire 138 has the dual purpose of serving as one electrical terminal and also to act as the stiffness member of the spring-mass system. Vibration sensor 130 is located on the circuit board for protection module 86 and is most sensitive to vibration in the plane which is perpendicular to the long axis of vibration sensor 130 or the long axis of spring wire 138. Sensor 130 is actually a form of electrical switch which requires a minimum displacement before the momentary circuit closures or pulses begin to appear. A sensor input network block includes an RC filter which reduces the noise content of the signal.

In a given orientation, the response of vibration sensor 130 is governed by the stiffness of spring wire 138 and the mass of ball 140. System response is measured in terms of the amplitude of oscillations of ball 140 when vibration sensor 130 is attached to compressor 10. In principle, sensor 130 is designed to have a natural frequency close to the operating frequency of compressor 10. Preferably the natural frequency of sensor 130 is maintained on the higher side of the operating frequency of compressor 10 to eliminate nuisance trips. By controlling parameters such as the stiffness of spring wire 138, the mass of ball 140 and the gap between ball 140 and contactor ring 134, it is possible to design sensor 130 to trigger only above a specific value of input vibration. In this context, triggering is said to occur when ball 140 contacts ring 134. The stiffness of spring wire 138 is a function of the diameter, length and material of spring wire 138, the mass of ball 140 is a function of its material and its diameter. Thus, by making variations in these parameters, it is possible to change the response curve of sensor 130. The sensitivity of sensor 130 is determined by the gap between ball 140 and contact ring 134 and how close the natural frequency of sensor 130 is to the operating frequency of compressor 10. If the two frequencies are close, the system may be over sensitive; i.e. a small change in input vibration amplitude will result in a significant change in output vibration of movement of bail 140. Similarly, if the two frequencies are far apart, the system may be under sensitive and require a larger input vibration amplitude to cause a small change in output vibration or movement of ball 140. Computer studies and parallel experimental work has determined that a preferred sensor 130 will trigger at input signal levels of 10–15 mils of input vibration. This preferred design is insensitive to input vibration under 8 mils.

One issue which needs to be addressed with vibration sensor 130 is it must have the ability to distinguish between a true excessive vibration condition and the normal transient vibrations experienced during start up, flooded start, shut down and the like. Protection module 86 preferably includes a first counter which continuously counts any pulses or triggering that are present using a 10 second time interval. If the number of pulses counted during any 10 second interval exceeds a predetermined number, a limit condition flag is turned on. Conversely, if the number of pulses counted during any 10 second interval is less than a predetermined number, the limit condition flag is turned off. Protection module 86 implements a second counter which is an up-down counter. It is clocked by an internal 1 second clock. The counter is limited to 0 counts in the down direction and 120 counts in the up direction. If the condition limit flag is turned on, the counter counts up. If the limit condition flag is turned off, the counter counts down. If at any time the count reaches 120, protection module 86 turns off the control relay, sets the red indicator light 96 flash count to 1 and locks in this "vibration trip condition". Recycling of power to protection module 86 is required to clear this condition and reset the counter to 0.

The situation described above sets the red indicator light 96 flash count to 1. In this manner, indicator lights 94 and 96 indicate the operating conditions or problems associated with compressor 10. Indicator light 94 is a green indicator light and will indicate the following conditions. If light 94 is steady on, power to compressor 10 is on; if light 94 is slowly flashing, a two minute anti-short cycle is in process; if light 94 is rapidly flashing, there is a pending vibration trip; and if light 94 is off, the power is off or a trip condition as indicated by light 96 is present.

Indicator light 96 is a red indicator light and it is designed to indicate a specific problem with the operation of compressor 10. If indicator light 96 has a single flash, compressor 10 has been tripped due to an over temperature condition; if light 96 has a triple flash, compressor 10 has been tripped due to excessive vibrations; if light 96 has a double flash, compressor 10 has been tripped due to a phase rotation problem; if light 96 has four flashes, compressor 10 has been tripped due to a phase voltage problem; and if light 96 is on steadily, there has been an internal failure of protection module 86.

Figure 7:
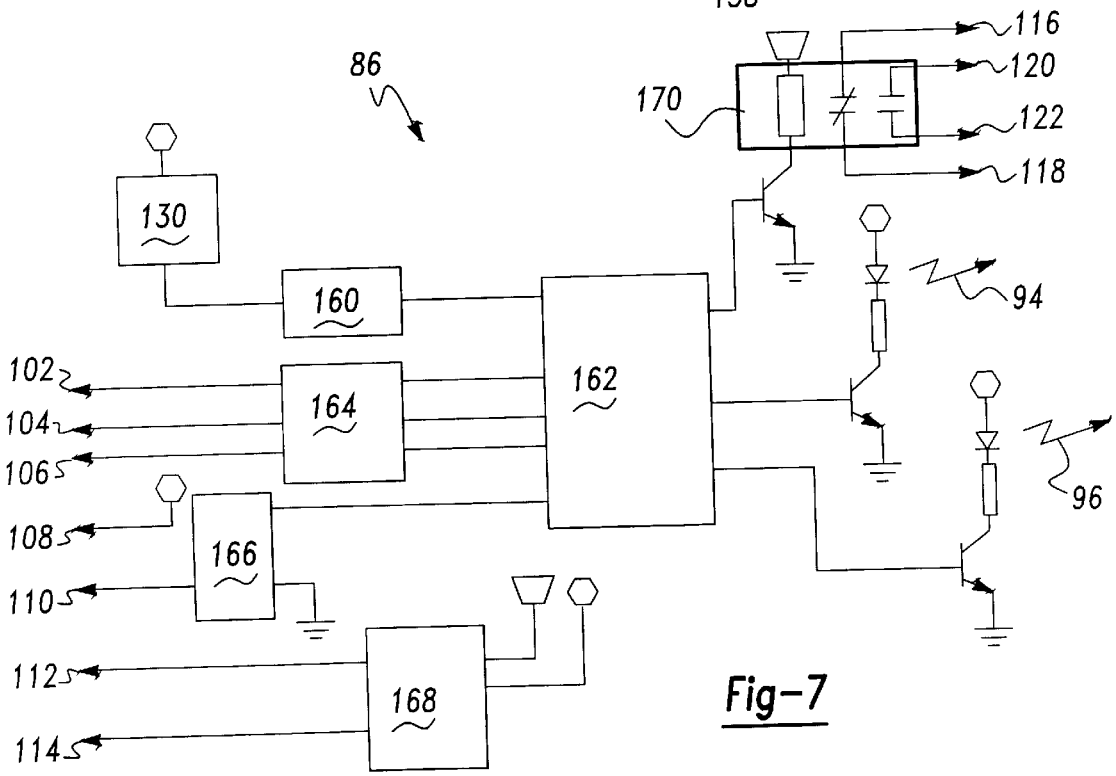
FIG. 7 is a functional block diagram of the protection module shown in FIG. 3.

FIG. 7 illustrates a functional block diagram of protection module 86. Protection module 86 includes vibration sensor 130 and a sensor input network 160 which is connected to a controller 162. Terminals 102, 104 and 106 are also connected to controller 162 through a signal conditioner 164. Terminals 108 and 110 are connected to controller 162 through a sensor input network 166. Protection module 86 shown in FIG. 7 receives AC power at terminals 112 and 114 and provides this AC power to an isolated power supply 168 which in turn supplies isolated DC power to the circuitry of the protection module 86. Terminals 116, 118, 120 and 122 are connected to controller 162 through a control relay 170 which either allows operation of compressor 10 or activates the alarm. Both indicator lights 94 and 96 also are connected to controller 162 to control their illumination.

While the above detailed description describes the preferred embodiment of the present invention, it should be understood that the present invention is susceptible to modification, variation and alteration without deviating from the scope and fair meaning of the subjoined claims.

What is claimed is:

1. A scroll machine comprising:

a shell;

a first scroll member disposed in said shell and having a first spiral wrap;

a second scroll member disposed in said shell and having a second spiral wrap, said wraps being mutually intermeshed;

means for causing said scroll members to orbit with respect to one another whereby said wraps create at least one enclosed space of progressively changing volume between a suction port and a discharge port;

a terminal box secured to said shell;

a protection module attached to said terminal box; and a vibration sensor secured to said protection module, said vibration sensor being capable of sensing an undesirable vibration and producing an indicative signal.

2. The scroll machine according to claim 1 further including a timer electrically connected with said vibration sensor, said timer requiring said vibration sensor to sense said undesirable vibration for a specified time period prior to stopping operation of said scroll machine.

3. The scroll machine according to claim 1 wherein, said protection module monitors an operating temperature of said scroll machine and stops operation of said scroll machine when said operating temperature is undesirable.

4. The scroll machine according to claim 3 wherein, said means for causing said scroll members to orbit includes a motor having a stator and a rotor, said operating temperature being a temperature of said stator.

5. The scroll machine according to claim 4 wherein, said protection module monitors a temperature of gas adjacent said discharge port.

6. The scroll machine according to claim 3 wherein, said operating temperature is a temperature of gas adjacent said discharge port.

7. The scroll machine according to claim 1 wherein, said means for causing said scroll members to orbit includes an electric motor, said protection module being operative to prevent operation of said scroll machine upon sensing an improper electrical connection to said electric motor.

8. The scroll machine according to claim 1 wherein said vibration sensor comprises:

a cover defining a bore;

a contactor ring disposed within said bore of said cover;

a terminal rod secured to said contactor ring and extending through said cover;

a spring wire disposed within said bore and extending through said cover, said spring wire having an end disposed within said contactor ring;

a ball secured to said end of said spring wire; and an end cap secured to said cover.

9. The scroll machine comprising:

a shell;

a first scroll member disposed in said shell and having a first spiral wrap;

a second scroll member disposed in said shell and having a second spiral wrap, said wraps being mutually intermeshed;

means for causing said scroll members to orbit with respect to one another whereby said wraps create at least one enclosed space of progressively changing volume between a suction port and a discharge port;

a terminal box secured to said shell; and a protection system secured to said terminal box, said protection system incorporating a temperature sensor disposed within said shell for detecting an undesirable temperature and a vibration sensor for detecting an undesirable vibration to prevent operation of said scroll machine.

10. The scroll machine according to claim 9 wherein, said protection system includes a timer for determining a length of time of said undesirable vibration, said protection system delaying the stopping of said scroll machine until said length of time reaches a predetermined value.

11. The scroll machine according to claim 9 wherein, said protection system is secured to said shell.

12. The scroll machine according to claim 9 wherein, said means for causing said scroll members to orbit includes a motor having a stator and a rotor, said temperature sensor monitoring said stator to determine said undesirable temperature.

13. The scroll machine according to claim 12 wherein, said temperature sensor monitors gas adjacent said discharge port to determine said undesirable temperature.

14. The scroll machine according to claim 9 wherein, said temperature sensor monitors gas adjacent said discharge port to determine said undesirable temperature.

15. The scroll machine according to claim 9 wherein, said means for causing said scroll members to orbit includes an electric motor, said protection system being operative to prevent operation of said scroll machine upon sensing an improper electrical connection to said electric motor.

16. The scroll machine according to claim 9 wherein, said protection system includes a vibration sensor, said vibration sensor comprising:

a cover defining a bore;

a contactor ring disposed within said bore of said cover;

a terminal rod secured to said contactor ring and extending through said cover;

a spring wire disposed within said bore and extending through said cover, said spring wire having an end disposed within said contactor ring;

a ball secured to said end of said spring wire; and an end cap secured to said cover.

17. The scroll machine comprising:

a shell;

a first scroll member disposed in said shell and having a first spiral wrap;

a second scroll member disposed in said shell and having a second spiral wrap, said wraps being mutually intermeshed;

means for causing said scroll members to orbit with respect to one another whereby said wraps create at least one enclosed space of progressively changing volume between a suction port and a discharge port;

a terminal box secured to said shell; and a protection system secured to said terminal box, said protection system incorporating a mis-wiring sensor for detecting a mis-wiring condition and a vibration sensor for detecting an undesirable vibration to prevent operation of said scroll machine.

18. The scroll machine according to claim 17 wherein, said protection system includes a timer for determining a length of time of said undesirable vibration, said protection system delaying the stopping of said scroll machine until said length of time reaches a predetermined value.

19. The scroll machine according to claim 17 wherein, said protection system is secured to said shell.

20. The scroll machine according to claim 17 wherein, said protection system includes a vibration sensor, said vibration sensor comprising:

a cover defining a bore;

a contactor ring disposed within said bore of said cover;

a terminal rod secured to said contactor ring and extending through said cover;

a spring wire disposed within said bore and extending through said cover, said spring wire having an end disposed within said contactor ring;

a ball secured to said end of said spring wire; and an end cap secured to said cover.

* * * * *